US005651467A

United States Patent [19]

Moran, III

[11] Patent Number: 5,651,467

[45] Date of Patent: Jul. 29, 1997

[54] DEMOUNTABLE FIREWOOD STORAGE RACK

[75] Inventor: Joseph P. Moran, III, Tulsa, Okla.

[73] Assignee: Jomoco Products Company, Tulsa, Okla.

[21] Appl. No.: 279,909

[22] Filed: Jul. 25, 1994

[51] Int. Cl.[6] ..... A47F 7/00

[52] U.S. Cl. ..... 211/49.1; 211/60.1; 211/189

[58] Field of Search ..... 211/49.1, 60.1, 211/189; 403/388, 400, 394

[56] References Cited

U.S. PATENT DOCUMENTS

| | | | |
|---|---|---|---|
| 3,157,424 | 11/1964 | Hall | 211/49.1 X |
| 3,581,907 | 6/1971 | Schmidt | 211/49.1 X |
| 3,945,497 | 3/1976 | Greenberg | 211/69.1 |
| 4,029,078 | 6/1977 | Eller | 211/49.1 X |
| 4,355,725 | 10/1982 | Humphrey | 211/59 |
| 4,449,842 | 5/1984 | Reichmar, Jr. | 403/25 |
| 4,616,757 | 10/1986 | Hobson | 211/189 |
| 4,685,576 | 8/1987 | Hobson | 211/189 |

*Primary Examiner*—Korie Chan

*Attorney, Agent, or Firm*—Head, Johnson & Kachi-Gian

[57] ABSTRACT

A demountable firewood storage rack formed of two length-defining timbers, four upright height-defining timbers and two metal brackets. Each of the brackets has a horizontal elongated connecting member having a first and second end, the first end having a first short-length inner tubular channel member and, welded to it on a side thereof opposite the connecting member, an outer short-length tubular member. The inner tubular members of each bracket are aligned in a common horizontal plane and the outer tubular members in a common vertical plane. The storage rack is assembled by inserting each end of each of the length-defining timbers into a horizontally oriented tubular member of a bracket so that the length-defining members and the brackets form a rectangle with four upwardly extending tubular members. The four upright timbers are removably inserted in the tubular members to form a rack on which firewood can be stored.

6 Claims, 2 Drawing Sheets

DEMOUNTABLE FIREWOOD STORAGE RACK

CROSS-REFERENCE TO RELATED APPLICATIONS

This application is not related to any pending patent applications.

CROSS-REFERENCE TO MICROFICHE APPENDIX

This application is not related to any microfiche appendix.

BACKGROUND OF THE INVENTION

Many homes and offices in the United States have wood burning fireplaces. Wood for fireplaces is cut in short-lengths of approximately 18–24 inches and stored usually outdoors, in a rack. Accordingly, many homes and offices have the problem of providing a rack for use in storing firewood. Many firewood racks are formed of metal length-defining members, such as pipe, with welded cross members connecting the length-defining members together to form a rectangle and with upstanding height-defining members that are welded to the metal length and width defining members. While a wood rack of this type functions successfully, it is expensive to produce, is heavy, is not demountable and is expensive to ship from a point of manufacture to a point of purchase.

To obviate these problems associated with a typical integral metal firewood storage rack, the concept of using timbers for construction of wood racks has been suggested. For specific reference to demountable wood racks that can be formed employing timbers, such as standard two-by-four lumber as used in the building trade, reference can be had to U.S. Pat. Nos. 4,616,757 and 4,685,576. These patents show brackets for receiving timbers to form wood racks or similar storage racks. Another reference that shows the use of brackets for receiving timbers is U.S. Pat. No. 4,449,842 entitled "Sleeve Bracket". The bracket covered by this patent is similar to the three-axis corner bracket shown in U.S. Pat. Nos. 4,616,757 and 4,685,576 referenced above.

The present invention provides an improved demountable firewood storage rack. The disclosure herein provides a system for demountably erecting a firewood storage rack utilizing two integral brackets and six timbers in an arrangement that makes assembly of the firewood storage rack simpler. Further, the assembled firewood storage rack is more stable than some other known demountable storage racks.

BRIEF SUMMARY OF THE INVENTION

The invention disclosed herein provides a demountable firewood storage rack formed of eight components. These include two length-defining timbers which may, as an example, be in the form of two two-by-four timbers as commonly employed in the residential construction business in the United States, and four upright timbers. In addition to these six lengths of timbers, which are readily available from any typical lumber yard selling building materials, two specially designed brackets are employed. The brackets are identical and preferably formed of metal and, still more preferably, formed of readily available structural components that are welded together.

Each of the brackets includes a horizontal connecting member having opposed ends. The connecting member can be formed of a length of tubular steel. Affixed to the first end of the tubular connecting member is a first short-length inner tubular member having a tubular axis. Affixed to the second end of the tubular connecting member is a second, identical, short-length inner tubular member having a tubular axis.

Affixed, such as by welding, to the first tubular member is a third short-length outer tubular member having a tubular axis. The third tubular member is secured to the first tubular member on a side thereof opposite to the connecting member. A fourth short-length outer tubular member having a tubular axis is secured to the second inner tubular member on the side thereof opposite to the connecting member. The short-length outer tubular members are secured in such a way that the inner tubular members are in a common plane with the connecting member, and the tubular axis of the outer tubular members are in a common plane that is oriented 90° to the common plane of the axis of the inner tubular members.

Two of the integral brackets, as have been described, are used with six timbers to readily assemble a wood storage rack. One bracket is affixed to the first end portion of each of two length-defining timbers, and a second bracket is affixed to the opposite end portion of each of the length-defining timbers. The brackets are affixed by merely sliding the tubular portions onto the ends of the length-defining timbers. The length-defining timbers may be received in either the inner or outer tubular members of each bracket. When two brackets are assembled with the two length-defining timbers, a rectangle is formed in a generally common plane that is positioned horizontally on a support surface, such as on the earth.

The four upright timbers, or height-defining timbers, are then inserted into the upright tubular members at each end of the brackets. The upright members serve to provide spaced apart end posts for each end of the assembled storage rack.

Since the timber members are slid into position on the tubular members forming a part of each bracket, the entire assembly can be quickly assembled, and the demountable firewood rack can be just as easily disassembled.

Since two-by-four timbers are readily available, the manufactured components necessary for forming a demountable wood rack consists of two integral brackets. These brackets can be economically packaged and shipped. They occupy a relatively small volume of space compared to that of an integral wood storage rack.

A better understanding of the invention will be obtained from the following detailed description, taken in conjunction with the attached claims and drawings.

DESCRIPTION OF THE PREFERRED EMBODIMENTS

Figure 2:
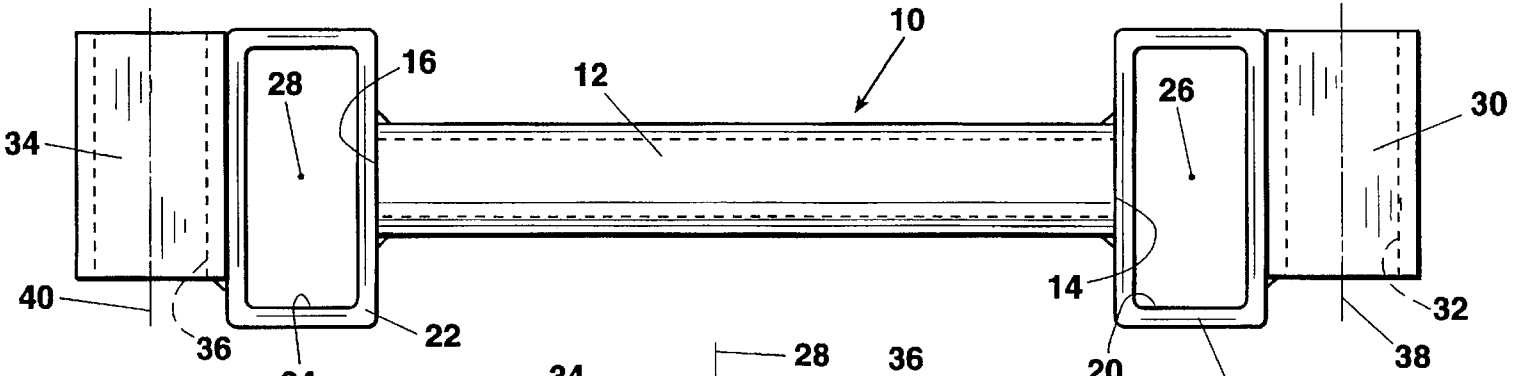
FIG. 2 is a top plan view of the bracket of FIG. 1 taken along the line 2—2 of FIG. 1.
Figure 3:
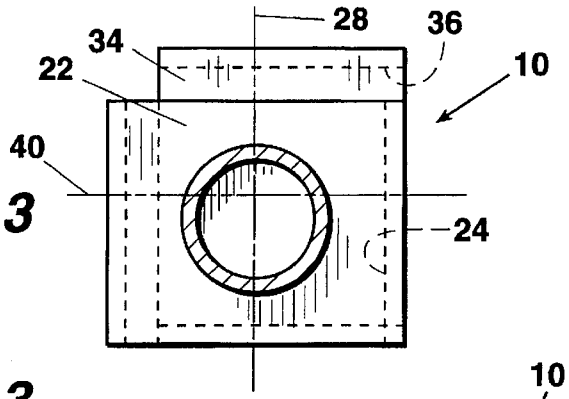
FIG. 3 is an elevational cross-sectional view of the bracket as taken along the line 3—3 of FIG. 1.
Figure 1:
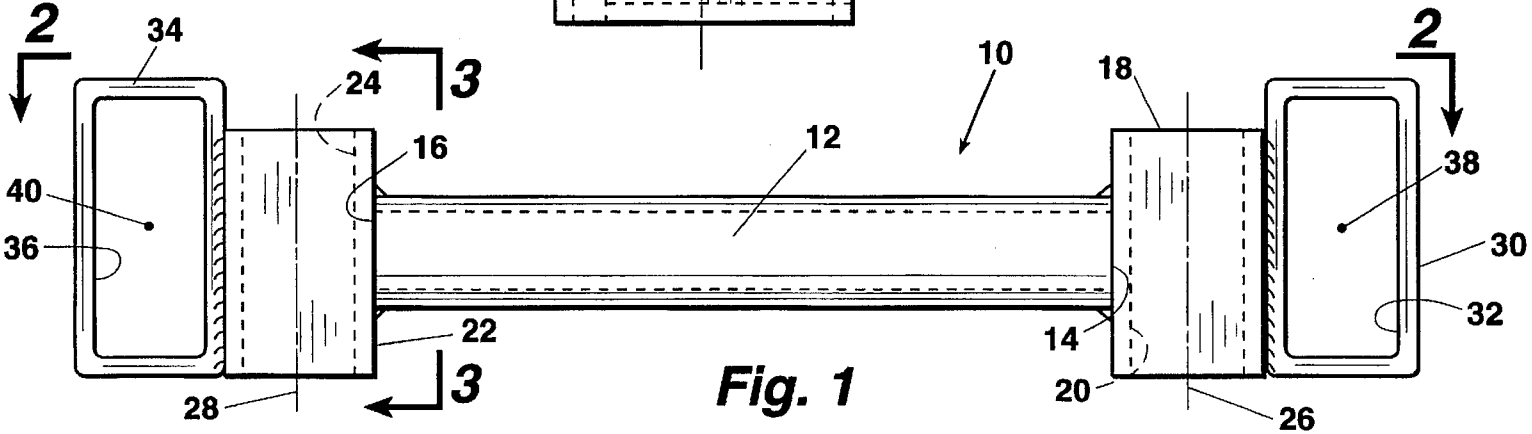
FIG. 1 is an elevational view of a bracket for use in forming a demountable firewood storage rack. Two of the brackets are employed, the brackets being identical.

Referring to the drawings and first to FIGS. 1, 2 and 3, the details of a bracket that is used for assembling a demountable firewood storage rack is shown, the bracket being generally indicated by numeral 10. Bracket 10 is formed by a horizontal elongated connecting member 12 that has a first end 14 and second end 16. Connecting member 12 is preferably of metal and may be any type of elongated structural member. One type of structural member that functions very successfully for connecting member 12 is a length of tubing. Tubing is preferred because of its readily availability, inherent strength, and economy. Affixed to connecting member first end 14 is a first short-length inner tubular member 18. Tubular member 18 is preferably formed of a length of tubular material cut to the desired length. Illustrated and preferred is the arrangement wherein tubular member 18 has an internal circumferential surface 20 that is rectangular. It can be seen that the first short-length inner tubular member 18 could be of other internal shape, such as cylindrical, however, the rectangular inner surface 20 is preferred since, as will be described subsequently, the timbers of which the demountable firewood storage rack is assembled utilizing bracket 10 are preferably commonly available two-by-four's. Therefore, internal surface 20 of tubular member 18 is preferably configured to slidably receive the standard commonly used two-by-four timber as employed in the home building industry in the United States.

Secured to the second end 16 of connecting member 12 is a second short-length inner tubular member 22 having an internal circumferential surface 24, the same as internal surface 20 of first tubular member 18. The second tubular member 22 is welded or otherwise secured to connecting member 12 in the same way as previously described with reference to the first tubular member. First tubular member 18 has a tubular axis 26, and second tubular member 22 has a tubular axis 28. The tubular axii 26 and 28 are in a common plane that substantially includes or at least is paralleled to the elongated connecting member 12.

Affixed, such as by welding, to first tubular member 18 on a side thereof opposite to connecting member 12 is a third short-length outer tubular member 30 having a circumferential internal surface 32 therein that is preferably of the same configuration as internal surfaces 20 and 24.

A fourth short-length outer tubular member 34 is secured to a side of second tubular member 22. Fourth tubular member 34 has an internal surface 36 that preferably is the same configuration as internal surfaces 20, 24 and 32, as previously described.

Third tubular member 30 has a tubular axis 38 and, in like manner, fourth tubular member 34 has a tubular axis 40. The tubular axii 38 and 40 of outer tubular members 30 and 34 are in a common plane which substantially includes or at least is paralleled to connecting member 12. The plane of tubular axii 38 and 40 is perpendicular to the plane of the tubular axii 26 and 28.

Figure 5:
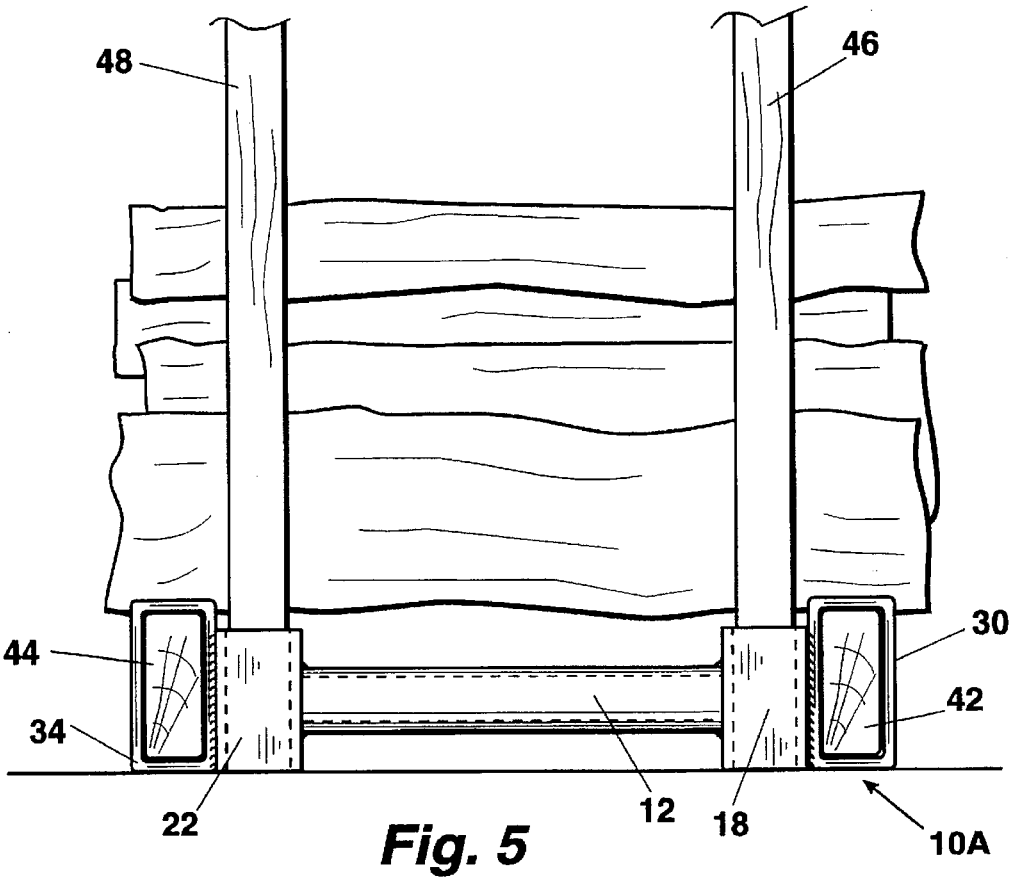
FIG. 5 is an enlarged dimensioned elevational partial end view as taken along the line 5—5 of FIG. 4 showing the means whereby firewood is stored on the demountable rack.
Figure 4:
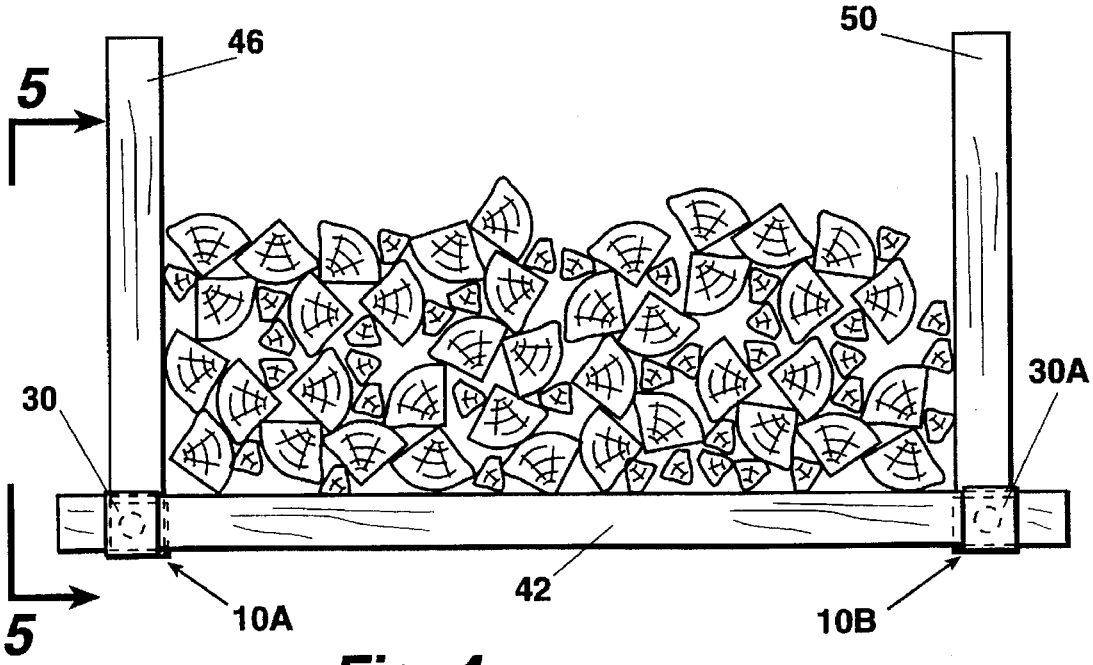
FIG. 4 is an elevational view of a firewood storage rack that has been assembled utilizing two of the brackets shown in FIGS. 1, 2, and 3, along with two length-defining timbers and four height-defining timbers.

Referring to FIGS. 4 and 5, the method of using bracket 10 is illustrated. To form a demountable firewood storage rack, two brackets 10 are employed. Extending between brackets 10A and 10B are two length-defining timbers 42 and 44. Timbers 42 and 44 can be made of wood of any cross-sectional shape that fits brackets 10A and 10B. When brackets 10A and 10B are constructed as shown in FIGS. 1, 2, and 3 wherein the internal surfaces 32 and 36 of tubular members 30 and 34 respectfully are of rectangular configuration, timbers 42 and 44 are formed of like rectangular shape. In the construction industry in the United States, a standard readily available timber that functions ideally for length-defining timbers 42 and 44 are referred to as "2×4's". The term "2×4's" means dimensional lumber having nominal cross-sectional dimensions that are slightly less than two-by-four inches. When two brackets 10 are secured to the opposed end portions of two spaced apart length-defining timbers 42 and 44, a horizontal rectangle is formed that can be positioned on the surface of the earth, on a patio or other supporting surface.

Positioned within inner tubular members 18 and 22 are upstanding timbers, there thus being four upstanding timbers 46–50, one of the upstanding timbers not being seen in FIGS. 4 and 5. The fourth, unseen, upstanding timber is positioned behind timber 50 in FIG. 4 and behind timber 48 in FIG. 5. The length of upstanding timbers 46, 48, and 50 can vary. The typical length of the upstanding timbers is 4 feet and the spacing between the length-defining timbers is 8 feet to constitute the normal firewood storage rack.

With all of the short-length tubular members being configured to slidably receive standard two-by-four timbers, it can be seen that the firewood storage rack can be quickly assembled employing two of brackets 10. Thus, brackets 10 may be manufactured, packaged and shipped together since the user can readily avail himself of two-by-four timbers.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A pair of integral brackets for use in erection of a firewood storage rack wherein the storage rack is assembled employing two horizontal length-defining load supporting timbers and four vertical height-defining timbers, the timbers being of generally uniform cross-sectional shape, two brackets being required for erection of a firewood storage rack, each bracket comprising:

a horizontal elongated fixed length non-load bearing connecting member having opposed first and second ends;

a first short-length inner tubular channel member integrally secured to said connecting member first end and having a tubular axis;

a second short-length inner tubular channel member integrally secured to said connecting member second end and having a tubular axis, the tubular axii of said first and second channel members being in a first common plane with said elongated connecting member;

a third short-length outer tubular channel member integrally secured to said first channel member on a side thereof opposite said connecting member and having a tubular axis; and a fourth short-length outer tubular channel member integrally secured to said second channel member on a side thereof opposite said connecting member and having a tubular axis, the tubular axii of said third and fourth channel members being in a second common plane that is perpendicular to said first common plane, wherein first and second ends of first and second paralleled spaced apart horizontal length-defining timbers are slidably receivable in one of said inner and outer tubular channel members of each of a pair of brackets and wherein four vertical height-defining timbers are slidably receivable in each of the other of said inner and outer said channel members of each of said pair of brackets, said connecting member being isolated from the weight of firewood storable on the horizontal length-defining members.

2. A pair of integral brackets for use in erecting a storage rack according to claim 1 wherein said connecting member, said inner tubular channel members and said outer tubular channel members are all of metal and are secured to each other by welding.

3. A pair of integral brackets for use in erecting a storage rack according to claim 1 wherein each of said short-length tubular channel members is of rectangular cross-sectional internal shape configured to slidably receive rectangular cross-sectional shaped timbers.

4. A demountable firewood storage rack, comprising:

two horizontal length-defining load supporting timbers each having first and second end portions;

four vertical height-defining timbers;

a first and a second support bracket, each support bracket defined by:

a horizontal elongated fixed length non-load bearing connecting member having opposed first and second ends;

a first short-length inner tubular member having a tubular axis and being integrally secured to said connecting member first end;

a second short-length inner tubular member having a tubular axis and being integrally secured to said connecting member second end;

a third short-length outer tubular member having a tubular axis and being integrally secured to said first inner tubular member on a side thereof opposite to said connecting member; and a fourth short-length outer tubular member having a tubular axis and being integrally secured to said second inner tubular member on a side thereof opposite to said connecting member, said two length-defining load supporting timbers being slidably receiving a said inner tubular members of a said support bracket on each said first and second end thereof so that said fixed length connecting members and said length-defining members form a rectangle in a substantially common plane, and one end of each of said vertical height-defining timbers being received in a said outer tubular member at each end of each of said connecting members to provide two vertical height-defining members in a common vertical plane at each of said ends of said horizontal length-defining timbers, said connecting members being isolated from the weight of firewood storable on said horizontal length defining members.

5. A demountable storage rack according to claim 4 wherein said connecting member, said inner tubular members and said outer tubular members are all of metal and are secured to each other by welding.

6. A demountable storage rack according to claim 4 wherein each of said short-length tubular members are of rectangular cross-sectional internal shape configured to slidably receive rectangular cross-sectional shaped timbers.

* * * * *